US008978312B2

(12) United States Patent
Chin-Yee

(10) Patent No.: US 8,978,312 B2
(45) Date of Patent: Mar. 17, 2015

(54) RAINWATER RUNOFF DIVERTING ATTACHMENT FOR BUILDING ROOFS

(71) Applicant: Stephen Albert Chin-Yee, Englewood, FL (US)

(72) Inventor: Stephen Albert Chin-Yee, Englewood, FL (US)

( * ) Notice: Subject to any disclaimer, the term of this patent is extended or adjusted under 35 U.S.C. 154(b) by 0 days.

(21) Appl. No.: 13/847,871

(22) Filed: Mar. 20, 2013

(65) Prior Publication Data

US 2013/0247479 A1 Sep. 26, 2013

Related U.S. Application Data

(60) Provisional application No. 61/613,574, filed on Mar. 21, 2012.

(51) Int. Cl.
*E04D 13/064* (2006.01)
*E04D 13/076* (2006.01)

(52) U.S. Cl.
CPC ..... *E04D 13/064* (2013.01); *E04D 13/076* (2013.01)
USPC ..... 52/11

(58) Field of Classification Search
CPC ..... E04D 13/076
USPC ..... 52/11, 12; 248/48.1
See application file for complete search history.

(56) References Cited

U.S. PATENT DOCUMENTS

| | | | | | |
|---|---|---|---|---|---|
| 3,248,827 | A * | 5/1966 | Hardy | 52/11 |
| 3,300,911 | A * | 1/1967 | Riddell | 52/16 |
| 3,501,873 | A * | 3/1970 | Berg | 52/11 |
| 3,913,284 | A * | 10/1975 | Hall | 52/11 |
| 4,271,643 | A * | 6/1981 | Sweers | 52/11 |
| 4,727,689 | A * | 3/1988 | Bosler | 52/12 |
| 4,796,391 | A * | 1/1989 | Lu | 52/73 |
| 4,813,190 | A * | 3/1989 | Wittig | 52/11 |
| 4,987,717 | A * | 1/1991 | Dameron, Jr. | 52/844 |
| D347,682 | S * | 6/1994 | Kennedy et al. | D23/267 |
| 7,010,887 | B2 * | 3/2006 | Walters | 52/11 |
| 2003/0167699 | A1 * | 9/2003 | Eyers | 52/11 |
| 2004/0262207 | A1 * | 12/2004 | Crosby | 210/162 |
| 2008/0005973 | A1 * | 1/2008 | Queiroz | 52/11 |
| 2011/0099916 | A1 * | 5/2011 | Minor et al. | 52/11 |
| 2013/0067830 | A1 * | 3/2013 | Sharkey | 52/12 |

FOREIGN PATENT DOCUMENTS

| | | | |
|---|---|---|---|
| DE | 3113219 | A1 * | 10/1982 |
| GB | 2146368 | A * | 4/1985 |

* cited by examiner

*Primary Examiner* — Christine T Cajilig

(57) ABSTRACT

A rainwater runoff diverting attachment for building roofs is an arrangement of thin, solid bodies connected in two dimensions and elongated in a third dimension. An attachment flange facilitates installation onto the fascia board of a building adjacent to the roof edge. Rainwater runoff falls into a runoff diversion trough and is diverted laterally. A projecting overhang ensures effective collection of rainwater runoff and provides shielding against debris falling into the runoff diversion trough.

13 Claims, 5 Drawing Sheets

RAINWATER RUNOFF DIVERTING ATTACHMENT FOR BUILDING ROOFS

The current application claims a priority to the U.S. Provisional Patent application Ser. No. 61/613,574 filed on Mar. 21, 2012.

FIELD OF THE INVENTION

The present invention relates generally to home gutters. More particularly, the present invention relates to an apparatus for redirecting rainwater runoff from building roofs.

BACKGROUND OF THE INVENTION

A roof is the covering on the uppermost part of a building. A roof protects the building and the contents of the building from the effects of weather, invasion of animals and other undesirable environmental factors. Structures that require roofs range from a letter box to a single family house to a cathedral or stadium, with dwellings being the most numerous. In most countries, a roof protects the inside of a building primarily against rain. Depending on the nature of the building, the roof may also protect against heat, sunlight, cold, snow and wind.

The construction of a roof is determined by its method of support, how the underneath space is bridged, and whether or not the roof is pitched. The pitch is the angle at which the roof rises from its lowest point to its highest point. Most domestic architecture in the United States, except in very dry regions, has roofs that are sloped, or pitched. Roofs are sometimes pitched for reasons of tradition and aesthetics but have traditionally been pitched so that rainwater runs off the roof and does not collect on the roof. Sometimes, modern construction elements such as drainpipes remove the need for pitching of roofs.

A rain gutter is a narrow channel, or trough, forming a component of a roof system that collects and diverts rainwater shed by the roof. The main purpose of a rain gutter is to protect a building's foundation by channeling water away from its base. The gutter also helps to reduce erosion, prevents leaks in basements and crawlspaces, and protects painted or stained surfaces by reducing exposure to water, and provides a means to collect rainwater for later use. Many buildings are built with rain gutters installed around the edges of the building's roof. However, in some cases, a rain gutter is not preinstalled, and rain water being displaced off the edge of a roof without being collected or channeled away from the edge of the roof may result in undesirable effects, such as water damage or nuisance cause by roof rain water falling off the roof onto electrical components such as an air conditioning unit, walkways, people, gardens, or other items beneath the roof line that are desired to be protected from the falling water.

Current roof rainwater diverting systems must be installed during the construction phase of the building or at the time of a reroofing operation in order to adequately seal the inner construction of the building against water intrusion into the disturbed roof area. In a residential home, for instance, a contractor must often be hired in order to install said rainwater diverting systems due to the knowledge and skills required, and cost is a prohibitive factor when a contractor has to install the rainwater diverting system.

It is therefore an object of the present invention to provide an apparatus for diverting roof rainwater runoff that can be cheaply, easily, and permanently installed by nearly any homeowner to divert rainwater as desired without requiring special tools or experience, and without the need to disturb or modify existing roofing components.

DETAIL DESCRIPTIONS OF THE INVENTION

Figure 1:
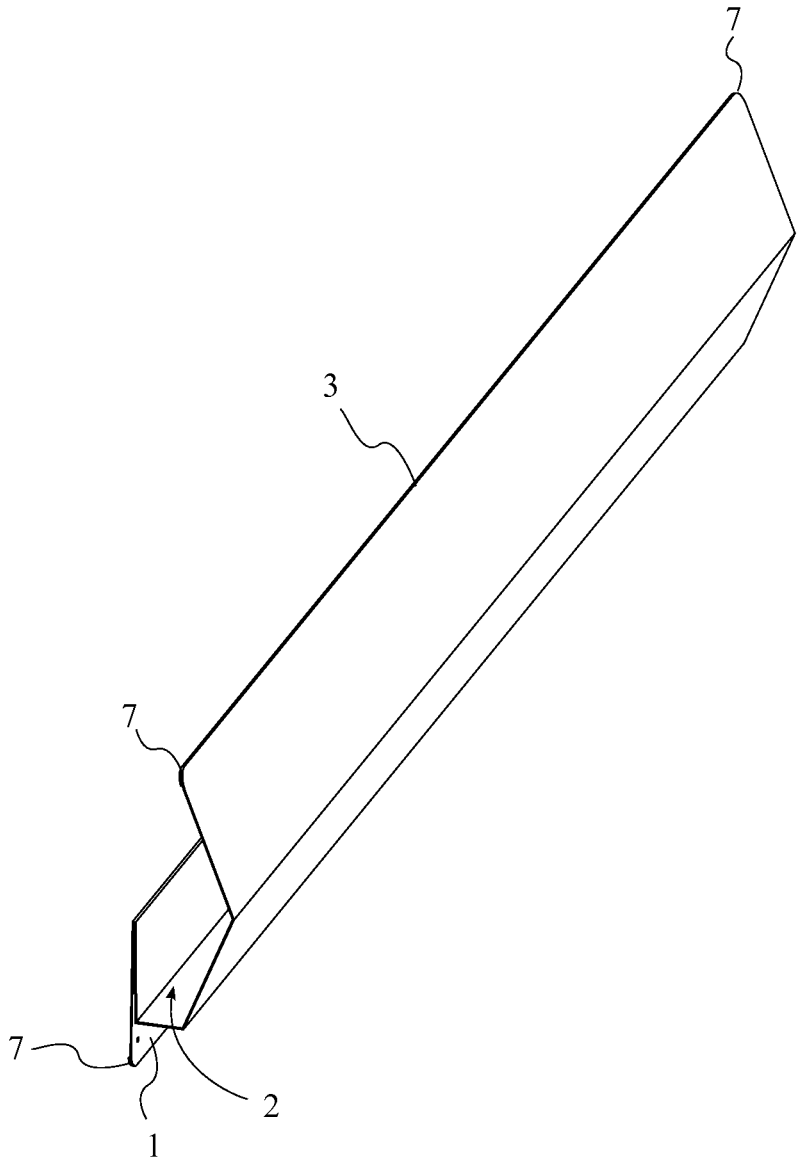
FIG. 1 is an elevated rear perspective view of the present invention.

All illustrations of the drawings are for the purpose of describing selected versions of the present invention and are not intended to limit the scope of the present invention.

The present invention is an apparatus for a building roof attachment that diverts rainwater runoff from the roof, and which may be installed cheaply and easily. The present invention is a solid, elongated structure with an invariant cross section, made from aluminum, steel, galvanized steel, titanium, or any other material that is strong, stiff and reasonably light enough to bear the weight of rainwater runoff, snow, leaves or other debris without unintentionally becoming detached from the building.

Referring to FIGS. 1-4, the present invention is an arrangement of thin, planar bodies connected to each other in two dimensions and elongated in a third dimension. The cross section of the present invention is invariant along the dimension in which the thin, planar bodies are elongated. The present invention comprises an attachment flange 1, a runoff diversion trough 2, a projecting overhang 3, a first lateral extremity 4, and a second lateral extremity 5. An exception to the invariance of the cross section of the present invention occurs at a plurality of rounded lateral corners 7. The attachment flange 1 allows the present invention to be installed on a building. The runoff diversion trough 2 collects rainwater runoff and diverts the rainwater runoff laterally. The projecting overhang 3 ensures total containment on the rainwater runoff in the runoff diversion trough 2. The first lateral extremity 4 and the second lateral extremity 5 are the endmost sides of the present invention along a total length 6 of the present invention. The plurality of rounded lateral corners 7 is for safety purposes, in an attempt to avoid injury to a user or damage to the building if an accident occurs.

Figure 2:
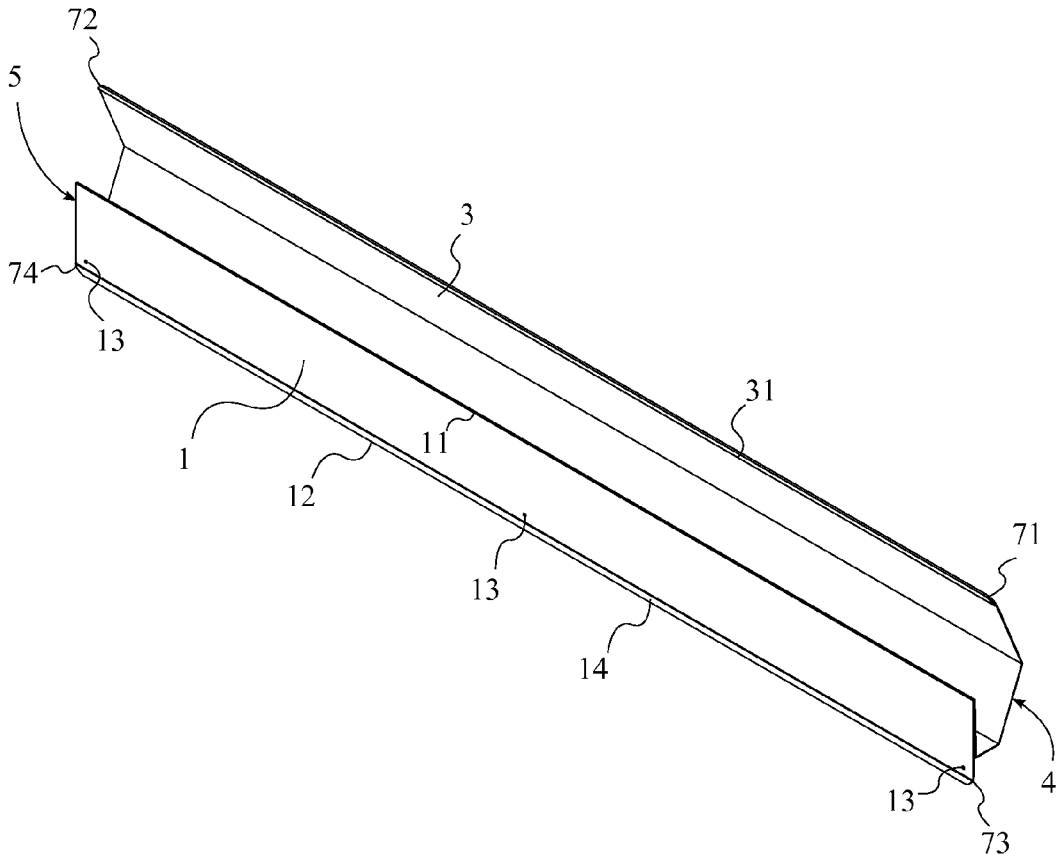
FIG. 2 is an elevated front perspective view of the present invention.
Figure 3:
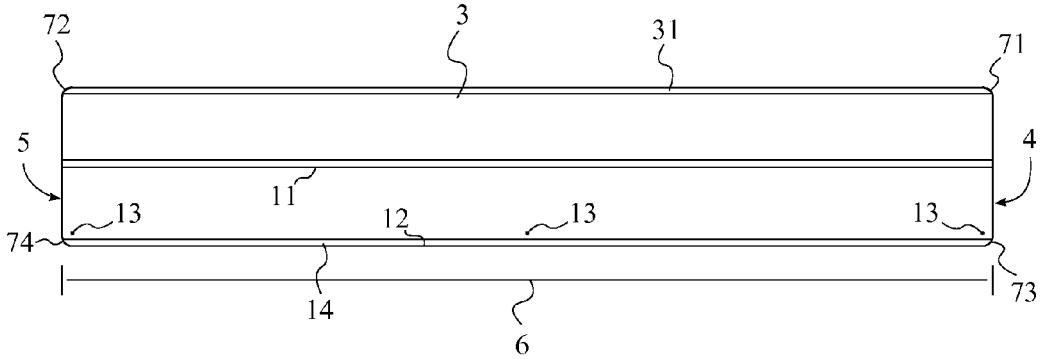
FIG. 3 is a front view of the present invention.

As can be seen in FIGS. 2-3, the first lateral extremity 4 and the second lateral extremity 5 of the present invention are positioned opposite each other along a total length 6 of the present invention, wherein the lateral cross section of the present invention is invariant along the total length 6 as previously described with the exception of the plurality of rounded lateral corners 7. The total length 6 of the present invention is defined along the third dimension in which the cross section of the present invention is elongated. In the preferred embodiment of the present invention, the total length 6 is 35.8 inches, though in alternate embodiments the total length 6 may be much less or much greater than 35.8 inches. Each of the plurality of rounded lateral corners 7 is positioned at either the first lateral extremity 4 or the second lateral extremity 5. Additional instances of the present invention may be joined adjacently to each other in order to provide a larger area of coverage for diverting roof rainwater runoff. The additional instances of the present invention may be joined together with a coupling or extender piece.

Figure 5:
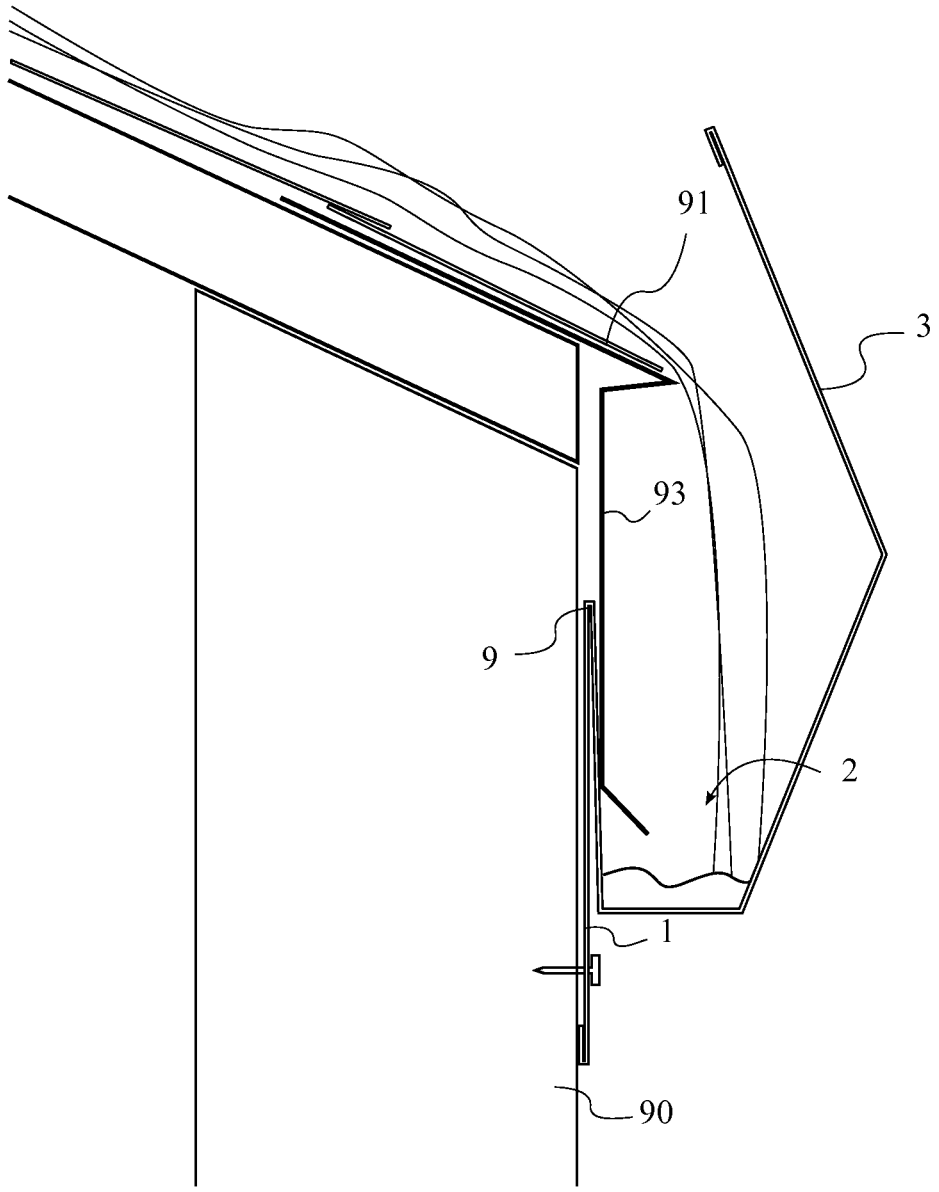
FIG. 5 is a side view of the present invention in use on a building.

The attachment flange 1 is the portion of the present invention that facilitates attachment of the present invention to a building. The attachment flange 1 comprises an upper flange edge 11, a lower flange edge 12, and a plurality of attachment holes 13. The runoff diversion trough 2 comprises a first trough wall 21, a second trough wall 22, and a trough bottom 23. The plurality of attachment holes 13 traverse through the attachment flange 1 adjacent to the lower flange edge 12. A lower rim flange 14 is connected to the lower flange edge 12 opposite the first trough wall 21. The lower rim flange 14 is preferably ¼ inch in length. The lower rim flange 14 is a portion of the attachment flange 1 at the lower flange edge 12 that is bent over on itself away from the runoff diversion trough 2. The lower rim flange 14 provides structural support to the attachment flange 1, stiffening the attachment flange 1 against bending. The lower rim flange 14 additionally provides a dull edge to prevent users from being cut while handling the present invention, and improves the aesthetics of the present invention. The plurality of attachment holes 13 are equally distributed along the total length 6 of the present invention, and allow the present invention to be installed on a building using nails or screws. As can be seen in FIG. 5, to install the present invention, the attachment flange 1 is connected to a fascia board 90 of the building below a roof edge 91 of the building by driving nails, screws or other appropriate fasteners through the plurality of attachment holes 13 into the fascia board 90. In the preferred embodiment of the present invention, the plurality of attachment holes 13 comprises three holes, but in alternate embodiments of the present invention the plurality of attachment holes 13 may comprise more or less than three holes.

Figure 4:
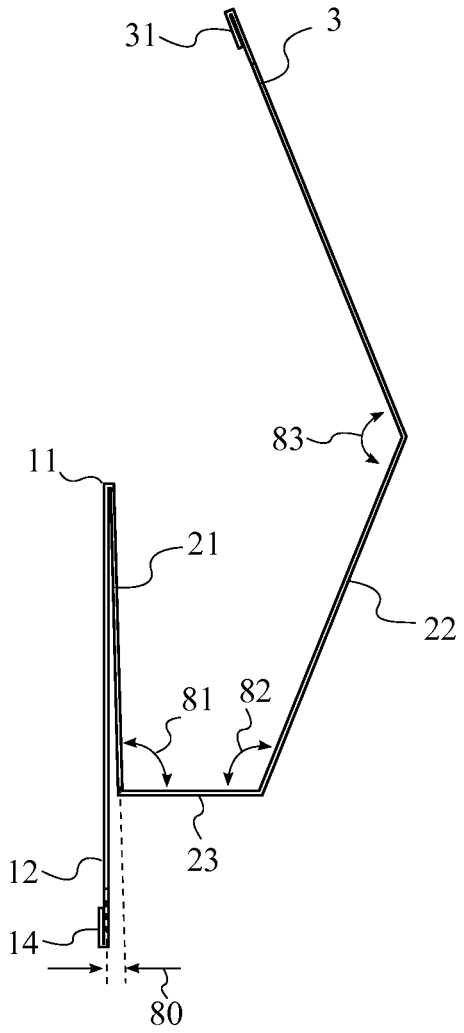
FIG. 4 is a cross sectional view of the present invention.

Referring to FIG. 4, the upper flange edge 11 is positioned opposite the lower flange edge 12 along the attachment flange 1 so that the upper flange edge 11 and the lower flange edge 12 are oriented vertically with respect to each other along the attachment flange 1. The upper flange edge 11 is connected to the first trough wall 21. The upper flange edge 11 and the first trough wall 21 are oriented substantially parallel to each other so that in the preferred embodiment of the present invention, a first angle 80 between the attachment flange 1 and the first trough wall 21 is near 0 degrees. However, in an alternate embodiment of the present invention, the first angle 80 may have a larger dimension such as, but not limited to, 5 degrees, 10 degrees, 15 degrees, or 30 degrees.

The junction between the upper flange edge 11 and the first trough wall 21 forms a pliable prong 9. Many buildings utilize a drip edge 93 in order to guide rainwater runoff away from the edge of the building in order to protect the roof sheathing and fascia board 90 from rotting. As can be seen in FIG. 5, when installing the present invention on the building under the drip edge 93, the pliable prong is inserted between the drip edge 93 and the fascia board 90. The first trough wall 21 should press against the inside of the drip edge in order to assist in maintaining the present invention in place at the installation location. The present invention is easily installed below the drip edge 93 to the fascia board 90 with the combination of fasteners such as nails or screws that are driven through the plurality of attachment holes 13, and the pliable prong 9 being held between the fascia board 90 and the drip edge 93.

The runoff diversion trough 2 is a substantially U-shaped channel that catches rainwater runoff and diverts the rainwater runoff laterally. The rainwater runoff falling from the roof edge 91 is caught within the runoff diversion trough 2. The rainwater runoff is dispersed toward either the first lateral extremity 4, the second lateral extremity 5, or both, so that the rainwater runoff is guided away from areas below the roof containing items or areas that may be damaged or otherwise disturbed by the falling rainwater runoff.

The trough bottom 23 is connected to the first trough wall 21 opposite the upper flange edge 11. In the preferred embodiment of the present invention, the trough bottom 23 is oriented horizontally, and a second angle 81 between the first trough wall 21 and the trough bottom 23 is near 90 degrees, though in alternate embodiments of the present invention, the second angle 81 may be more or less than 90 degrees.

The second trough wall 22 is connected to the trough bottom 23 opposite the first trough wall 21. The first trough wall 21, the trough bottom 23, and the second trough wall 22 are connected in series to form a substantially U-shaped channel. In the preferred embodiment of the present invention, a third angle 82 between the second trough wall 22 and the trough bottom 23 is approximately 112 degrees, though in alternate embodiments of the present invention the third angle 82 may be more or less than 112 degrees.

The projecting overhang 3 is connected to the second trough wall 22 opposite the trough bottom 23. In the preferred embodiment of the present invention, a fourth angle 83 between the second trough wall 22 and the projecting overhang 3 is 136 degrees. The projecting overhang 3 extends upward and toward the roof edge 91. In the preferred embodiment of the present invention, an upper rim flange 31 is connected to the topmost portion of the projecting overhang 3. The upper rim flange 31 is a portion of the projecting overhang that is bent over on itself towards the runoff diversion trough 2. The upper rim flange 31 is preferably ¼ inch in length. The upper rim flange 31 provides structural support to the projecting overhang 3, stiffening the projecting overhang 3 against bending. The upper rim flange 31 additionally provides a dull edge to prevent users from being cut while handling the present invention, and improves the aesthetics of the present invention.

Referring to FIGS. 2-3, in the preferred embodiment of the present invention, the plurality of rounded lateral corners 7 comprises a first upper corner 71, a second upper corner 72, a first lower corner 73, and a second lower corner 74. The first upper corner 71 is at the uppermost extremity of the projecting overhang 3 at the first lateral extremity 4. The second upper corner 72 is at the uppermost extremity of the projecting overhang 3 at the second lateral extremity 5. The first lower corner 73 is at the lower flange edge 12 at the first lateral extremity 4, and the second lower corner 74 is at the lower flange edge 12 at the second lateral extremity 5. Each of the plurality of rounded lateral corners 7 preferably has a radius of ⅜ inch.

Linear dimensions for the preferred embodiment of the present invention are as follows. The following description is not intended to precisely limit the present invention, but to demonstrate the spirit of the present invention and to disclose the preferred embodiment. The vertical distance between the lower flange edge 12 and the trough bottom 23 is 1 inch. The vertical distance between the trough bottom 23 and the upper flange edge 11 is 2 inches. The horizontal length of the trough bottom 23 is 1 inch. The length of the second trough wall 22 along the orientation defined by the third angle 82 is 2.5 inches. The length of the projecting overhang 3 along the orientation defined by the fourth angle 83 is 3 inches. It is conceivable that one or more dimensions could be changed by one or more inches without impacting the functionality of the present invention.

Although the invention has been explained in relation to its preferred embodiment, it is to be understood that many other possible modifications and variations can be made without departing from the spirit and scope of the invention as hereinafter claimed.

What is claimed is:

1. A rainwater runoff diverting attachment for building roofs comprises:

an attachment flange;

a runoff diversion trough;

a projecting overhang;

a first lateral extremity;

a second lateral extremity;

the attachment flange comprises an upper flange edge, a lower flange edge, and a plurality of attachment holes;

the runoff diversion trough comprises a first trough wall, a second trough wall, and a trough bottom;

the first lateral extremity and the second lateral extremity being positioned laterally opposite each other along a total length;

the attachment flange is attached to a fascia board of a building below a roof edge;

the projecting overhang extends above the roof edge;

rainwater runoff falling from the roof edge is caught within the runoff diversion trough; and the rainwater runoff is dispersed toward either the first lateral extremity, the second lateral extremity, or both the first lateral extremity and the second lateral extremity.

2. The rainwater runoff diverting attachment for building roofs as claimed in claim 1 comprises:

the upper flange edge being positioned vertically opposite the lower flange edge along a height of the attachment flange, wherein the upper flange edge and the lower flange edge are oriented vertically with respect to each other along the height of the attachment flange;

the plurality of attachment holes traversing through the attachment flange adjacent to the lower flange edge; and the plurality of attachment holes being equally distributed along the total length.

3. The rainwater runoff diverting attachment for building roofs as claimed in claim 1 comprises:

the upper flange edge of the attachment flange being attached to the first trough wall;

the trough bottom being attached to the first trough wall opposite the upper flange edge; and the second trough wall being attached to the trough bottom opposite the first trough wall, wherein the first trough wall, the trough bottom, and the second trough wall form a U-shaped channel; and a junction between the upper flange edge and the first trough wall forming a pliable prong, wherein the pliable prong is inserted in between the fascia board of a building and a drip edge of a building below a roof edge.

4. The rainwater runoff diverting attachment for building roofs as claimed in claim 3 comprises:

a first angle between the attachment flange and the first trough wall being near 0 degrees;

a second angle between the first trough wall and the trough bottom being near 90 degrees; and a third angle between the second trough wall and the trough bottom being approximately 112 degrees.

5. The rainwater runoff diverting attachment for building roofs as claimed in claim 1 comprises:

the projecting overhang being attached to the second trough wall opposite the trough bottom.

6. The rainwater runoff diverting attachment for building roofs as claimed in claim 5 comprises:

a fourth angle between the second trough wall and the projecting overhang being approximately 136 degrees.

7. A rainwater runoff diverting attachment for building roofs comprises:

an attachment flange;

a runoff diversion trough;

an projecting overhang;

a first lateral extremity;

a second lateral extremity;

the attachment flange comprises an upper flange edge, a lower flange edge, and a plurality of attachment holes;

the runoff diversion trough comprises a first trough wall, a second trough wall, and a trough bottom;

the first lateral extremity and the second lateral extremity being positioned laterally opposite each other along a total length;

the upper flange edge of the attachment flange being attached to the first trough wall;

the trough bottom being attached to the first trough wall opposite the upper flange edge;

the second trough wall being attached to the trough bottom opposite the first trough wall; and the projecting overhang being attached to the second trough wall opposite the trough bottom, wherein the first trough wall, the trough bottom, and the second trough wall form a U-shaped channel; and a junction between the upper flange edge and the first trough wall forming a pliable prong, wherein the pliable prong is inserted in between a fascia board of a building and a drip edge of a building below a roof edge.

8. The rainwater runoff diverting attachment for building roofs as claimed in claim 7 comprises:

the upper flange edge being positioned vertically opposite the lower flange edge along a height of the attachment flange, wherein the upper flange edge and the lower flange edge are oriented vertically with respect to each other along the height of the attachment flange;

the plurality of attachment holes traversing through the attachment flange adjacent to the lower flange edge; and the plurality of attachment holes being equally distributed along the total length.

9. The rainwater runoff diverting attachment for building roofs as claimed in claim 7 comprises:

a first angle between the attachment flange and the first trough wall being near 0 degrees;

a second angle between the first trough wall and the trough bottom being near 90 degrees;

a third angle between the second trough wall and the trough bottom being approximately 112 degrees; and a fourth angle between the second trough wall and the projecting overhang being approximately 136 degrees.

10. The rainwater runoff diverting attachment for building roofs as claimed in claim 7, the attachment flange is attached to the fascia board of a building below a roof edge;

the projecting overhang extends above the roof edge;

rainwater runoff falling from the roof edge is caught within the runoff diversion trough; and the rainwater runoff is dispersed toward either the first lateral extremity, the second lateral extremity, or both the first lateral extremity and the second lateral extremity.

11. A rainwater runoff diverting attachment for building roofs comprises:

an attachment flange;

a runoff diversion trough;

an projecting overhang;

a first lateral extremity;

a second lateral extremity;

the attachment flange comprises an upper flange edge, a lower flange edge, and a plurality of attachment holes;

the runoff diversion trough comprises a first trough wall, a second trough wall, and a trough bottom;

the first lateral extremity and the second lateral extremity being positioned laterally opposite each other along a total length;

the upper flange edge being positioned vertically opposite the lower flange edge along a height of the attachment flange, wherein the upper flange edge and the lower flange edge are oriented vertically with respect to each other along the height of the attachment flange;

the plurality of attachment holes traversing through the attachment flange adjacent to the lower flange edge;

the plurality of attachment holes being equally distributed along the total length;

the upper flange edge of the attachment flange being attached to the first trough wall;

a junction between the upper flange edge and the first trough wall forming a pliable prong, wherein the pliable prong is inserted in between a fascia board of a building and a drip edge of a building below a roof edge;

the trough bottom being attached to the first trough wall opposite the upper flange edge;

the second trough wall being attached to the trough bottom opposite the first trough wall, wherein the first trough wall, the trough bottom, and the second trough wall form a U-shaped channel; and the projecting overhang being attached to the second trough wall opposite the trough bottom.

12. The rainwater runoff diverting attachment for building roofs as claimed in claim 11 comprises:

a first angle between the attachment flange and the first trough wall being near 0 degrees;

a second angle between the first trough wall and the trough bottom being near 90 degrees;

a third angle between the second trough wall and the trough bottom being approximately 112 degrees; and a fourth angle between the second trough wall and the projecting overhang being approximately 136 degrees.

13. The rainwater runoff diverting attachment for building roofs as claimed in claim 11, the attachment flange is attached to the fascia board of the building below the roof edge;

the projecting overhang extends above the roof edge;

rainwater runoff falling from the roof edge is caught within the runoff diversion trough; and the rainwater runoff is dispersed toward either the first lateral extremity, the second lateral extremity, or both the first lateral extremity and the second lateral extremity.

* * * * *